US005839794A

United States Patent [19]

Boucherie

[11] Patent Number: 5,839,794

[45] Date of Patent: Nov. 24, 1998

[54] AUTOMATIC FILLING DEVICE FOR FIBRE CARTRIDGE AND/OR FIBRE CASSETTES OF BRUSH MANUFACTURING MACHINES

[75] Inventor: Leonel Polydore Boucherie, Izegem, Belgium

[73] Assignee: Firma G.B. Boucherie, naamloze vennootschap, Izegem, Belgium

[21] Appl. No.: 816,597

[22] Filed: Mar. 13, 1997

[30] Foreign Application Priority Data

Mar. 13, 1996 [BE] Belgium ..... 09600222

[51] Int. Cl.[6] ..... A46D 1/04

[52] U.S. Cl. ..... 300/7

[58] Field of Search ..... 300/2–11, 21

[56] References Cited

U.S. PATENT DOCUMENTS 4,609,228 9/1986 Bickel ..... 300/21

4,680,850 7/1987 Boucherie ..... 300/9

4,688,857 8/1987 Boucherie ..... 300/7

FOREIGN PATENT DOCUMENTS 901006 5/1985 Belgium .

*Primary Examiner*—Mark Rosenbaum

*Attorney, Agent, or Firm*—Bacon & Thomas, PLLC

[57] ABSTRACT

Automatic filling device for fiber cartridges (3) and fiber cassettes of brush manufacturing machines wherein each fiber duct (2–3) is provided with a pair of fiber gripping tongs (23) which can be moved between two positions, namely a position at the level of a take-up point (A) for bundles of fibers and a position which forms a supply point (B) in the respective fiber duct.

14 Claims, 1 Drawing Sheet

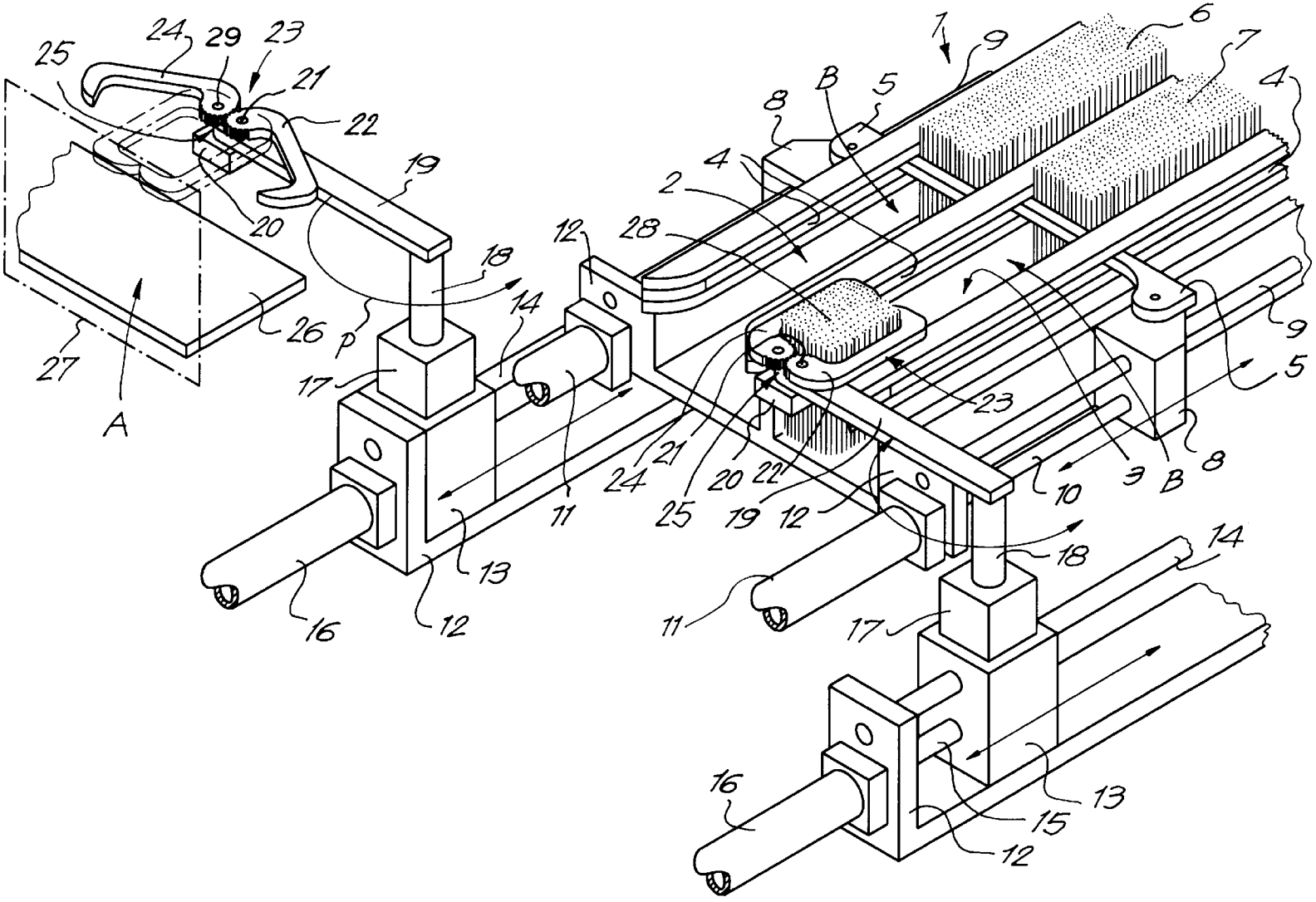
1
2
3
4
5
6
7
8
9
10
11
12
13
14
15
16
17
18
19
20
21
22
23
24
25
26
27
28
29
A
B
P

AUTOMATIC FILLING DEVICE FOR FIBRE CARTRIDGE AND/OR FIBRE CASSETTES OF BRUSH MANUFACTURING MACHINES

BACKGROUND OF THE INVENTION

1. Field of the Invention

The present invention concerns a filling device for fiber cartridges and fiber cassettes which are used in a brush manufacturing machine.

2. Description of the Related Art

With known brush manufacturing machines, the fiber cartridges or fiber cassettes are usually filled manually. This is disadvantageous because the brush manufacturing machine can only be operated continuously if an operator is present full-time. Moreover, during the filling, the operator's hands can be easily caught in an inadequately protected fiber supply opening of the brush manufacturing machine, which inevitably leads to work accidents.

Belgian patent No. 901 006 of the Applicant describes an automatic filling device having fiber gripping tongs fixed in a rotatably manner on a conveyor part. In order to move loose fibers from a bundle chamber into a single or multiple fiber cartridge or fiber cassette, the fiber gripping tongs must rotate from a vertical position to a horizontal position thereby requiring at least three linear movements by the conveyor part.

A disadvantage of this known device is that complex mechanical parts are required to realize the time-consuming movements carried out by the fiber gripping tongs. Another disadvantage is that with a multiple fiber cartridge, only one pair of gripping tongs is used to fill the different fiber ducts. This requires even more complicated mechanical parts and reduces the efficiency of the filling.

The invention aims to exclude the above-mentioned and other disadvantages.

SUMMARY OF THE INVENTION

To this aim, the automatic filling device for fiber cartridges and fiber cassettes of brush manufacturing machines contains a pair of fiber gripping tongs for each fiber duct. Each pair of tongs can be moved between two positions, namely a position at the level of a take-up point for bundles of fibers and a position which forms a supply point in the respective fiber duct.

The fiber gripping tongs in the device according to the invention carry out simple movements so that the number of mechanical parts of the filling device can be reduced greatly.

Since each fiber duct of a multiple fiber cartridge can be provided with a pair of fiber gripping tongs, the filling can be carried out fast and efficiently so that the brush manufacturing machine has a high production capacity.

The automatic filling device according to the invention will also guarantee the maximum safety of the operator.

By using an automatic filling device, the operator no longer needs to have direct access to the fiber cartridge. The filling is carried out from a distance. The supply opening to the fiber cartridge can be reduced to a minimum. The brush manufacturing machine can be surrounded entirely by a protective cover. Therefore, the operator can be optimally protected from the entire brush manufacturing machine with the exception of said very small supply opening.

BRIEF DESCRIPTION OF THE DRAWING

To better explain the characteristics of the invention, the following preferred embodiment of an automatic filling device for fiber cartridges and fiber cassettes of brush manufacturing machines according to the invention is described as an example only, without being limitative in any way, with reference to the accompanying drawing in which a preferred embodiment is represented schematically and in perspective.

DETAILED DESCRIPTION OF THE PREFERRED EMBODIMENT

The automatic filling device for fiber cartridges and fiber cassettes according to the invention is designed to continuously supply a brush manufacturing machine with fibers. Although such an automatic filling device can be used both for a single and a multiple fiber cartridge, a double fiber cartridge will be described in the following example.

In the accompanying drawings a double fiber cartridge 1 is formed of two fiber ducts 2 and 3. Each fiber duct 2 and 3 is provided with a guide 4 in which a catch 5 can be moved.

Catches 5 press in a known way on fibers 6–7 which are present in fiber ducts 2 and 3. Under a certain spring pressure catches 5 are fixed by hinges on a carriage 8.

Carriage 8 can move along a guide 9 and is connected to a piston rod 10 of a pressure cylinder 11, the body of which is fixed on a frame 12 of the machine.

Next to fiber cartridge 1 on a part of frame 1 2, a carriage 13 for each fiber duct 2 and 3 is provided. Each carriage 13 can be moved along a guide 14 and is connected to a piston rod 1 5 of a pressure cylinder 16, the body of which is fixed on frame 12 of the machine.

On each carriage 13, a tong driving motor is provided which is schematically represented by 17. Driving motor 17 can be a motor, for example, having an output shaft 18 which is connected at its free end with one end of a drive bar 19. A driving motor 20 is provided at the other end of bar 19. Driving motor 20 can be a motor, for example, having an output shaft 21. A jaw 22 of a pair of fiber gripping tongs 23 is fixed on output shaft 21. A jaw 24 of this pair of fiber gripping tongs 23 is fixed on an additional shaft 29, which is bearing-mounted on bar 19. Gear teeth 25 are provided between jaws 22 and 24.

Fiber gripping tongs 23 are positioned somewhat above the upper surface of fiber cartridge 1 and carry out all the necessary movements in this high position.

A bearing face 26 is provided for bundles of fibers under each pair of gripping tongs at a take-up point A in the brush manufacturing machine.

The working of the device according to the invention is very simple and as follows.

Since both fiber transmission devices are the same, the following description of the operation will be limited to one of these devices.

Bundles of fibers 28 are placed on bearing face 26 through an opening 27 in the protective cover of the brush manufacturing machine.

After bundles of fibers are placed on bearing face 26, fiber gripping tongs 23 are driven by driving motor 20 such that, through cooperation of teeth 25 between jaws 22 and 24, jaws 22 and 24 move simultaneously towards one another. Jaws 22 and 24 move into a position, represented by dashed lines in the drawing, in order to clasp a bundle of fibers.

Subsequently, driving motor 17 rotates shaft 1 8, and consequently bar 19 with fiber gripping tongs 23, through an angle of 180° according to arrow P. Then pressure cylinder 16 is controlled such that carriage 13 moves into the vicinity of fibers 6 of fiber duct 2, i.e., until it reaches catch 5. This position in the brush manufacturing machine forms a supply point B for bundles of fibers.

During said movement, bar 19, together with fiber gripping tongs 23, will always be located at a level right above the top of fiber cartridge 1.

When tongs 23 gripping a bundle of fibers reaches supply point B, carriage 8, together with catch 5, is removed from fibers 6 by pressure cylinder 11, past the bundle of fibers, whereby catch 5 hinges away past said bundle to end up behind the bundle in the known manner. Carriage 8 is then driven such that the bundle of fibers is added in an appropriate manner to fibers 6, which are already present in cartridge 1, by catch 5 pressing onto the fibers.

Jaws 22 and 24 of fiber gripping tongs 23 are then opened by driving motor 20 and meshing teeth 25. Fiber gripping tongs 23 are placed outside fiber cartridge 1 as carriage 13 is moved back to take-up point A and are rotated outward by driving means 17 until they arrive above bearing face 26 to grasp a new bundle of fibers.

Although in the figures driving motor 20 are provided at the bottom of bar 19, it is clear that driving means 20 can be applied above fiber gripping tongs 23 should they hamper the appropriate movement of catch 5.

The device according to the present invention has a very simple design which guarantees a very high degree of operational safety. Fiber ducts 2 and 3 can be replenished either simultaneously or not. In the case of machines which are entirely protected by a cover, only one or two small openings 27 are to be provided in the cover for the supply of bundles of fibers to the machine so that the risk of the operator being hurt by moving machine parts is practically zero.

The invention is by no means limited to the above-described embodiment represented in the accompanying drawing; on the contrary, such an automatic filling device for fiber cartridges and fiber cassettes of brush manufacturing machines can be made in all sorts of variants and in various forms and dimensions while still remaining within the scope of the invention.

I claim:

1. An automatic filling apparatus for fiber cartridges and fiber cassettes of a brush manufacturing machine, comprising: at least two fiber ducts each including a supply point; at least one take-up point for bundles of fibers; and an individual pair of fiber gripping tongs for each of said fiber ducts, each of said pairs of tongs movable between said take-up point and said supply point of said respective fiber duct.

2. An automatic filling apparatus according to claim 1, further comprising: a closed protective cover which surrounds said machine; and a small opening in said cover located opposite said take-up point.

3. An automatic filling apparatus according to claim 2, wherein said take-up point comprises a bearing face from which fibers are supplied through said small opening to said brush manufacturing machine.

4. An automatic filling apparatus according to claim 1, wherein each of said pairs of fiber gripping tongs comprises a first jaw and a second jaw, said jaws being hinged-mounted in relation to one another.

5. An automatic filling apparatus according to claim 4, further comprising: a respective drive shaft onto which said first jaw of each of said pairs of tongs is mounted; a respective auxiliary shaft onto which said second jaw of each of said pairs of tongs is mounted; a driving mechanism which rotates said respective drive shafts; and wherein each jaw of each of said pairs of tongs includes meshing gear teeth which cooperate between said respective first and second jaws to cause simultaneous movement of said second jaw when said first jaw is rotated.

6. An automatic filling apparatus according to claim 5, further comprising: a respective driving motor having a respective output shaft, said respective output shaft extending parallel to said respective drive shaft and parallel to said respective auxiliary shaft.

7. An automatic filling apparatus according to claim 6, wherein said output shafts, said drive shafts and said auxiliary shafts are disposed vertically.

8. An automatic filling apparatus according to claim 1, further comprising: a respective driving motor having a respective output shaft; and a respective drive bar connected at one end to said respective output shaft and connected at the other end to one of said pairs of fiber gripping tongs.

9. An automatic filling apparatus according to claim 8, further comprising: a respective carriage on which said respective drive motor and respective drive bar are mounted; and a respective guide along which said respective carriage is movable.

10. An automatic filling apparatus according to claim 9, further comprising: a respective pressure cylinder having a body fixed on a frame of said machine and having a movable piston rod connected to said respective carriage for driving said respective carriage.

11. An automatic filling apparatus according to claim 9, wherein said carriages are movable horizontally.

12. An automatic filling apparatus according to claim 1, wherein said pairs of fiber gripping tongs are rotatable through an angle of 180°.

13. An automatic filling apparatus according to claim 1, wherein movement of said pairs of fiber gripping tongs comprises a combination of a rotational movement and a linear movement.

14. An automatic filling apparatus according to claim 13, wherein movement of said pairs of fiber gripping tongs occurs in a horizontal field.

* * * * *